US007906049B2

(12) United States Patent
Zenpo et al.

(10) Patent No.: US 7,906,049 B2
(45) Date of Patent: Mar. 15, 2011

(54) METHOD FOR FILLING A FOAM MIXTURE IN A CAVITY OF A METAL MOLD AND AN APPARATUS FOR MOLDING A MOLD

(75) Inventors: Toshihiko Zenpo, Toyokawa (JP); Yusuke Kato, Toyokawa (JP); Norihiro Asano, Toyokawa (JP); Kazuyuki Nishikawa, Toyokawa (JP); Toshio Kanno, Toyokawa (JP); Shinji Sonoyama, Toyokawa (JP)

(73) Assignee: Sintokogio, Ltd., Aichi (JP)

( * ) Notice: Subject to any disclaimer, the term of this patent is extended or adjusted under 35 U.S.C. 154(b) by 35 days.

(21) Appl. No.: 12/096,427

(22) PCT Filed: Nov. 8, 2006

(86) PCT No.: PCT/JP2006/322261

§ 371 (c)(1),
(2), (4) Date: Jun. 6, 2008

(87) PCT Pub. No.: WO2007/069411

PCT Pub. Date: Jun. 21, 2007

(65) Prior Publication Data

US 2010/0001424 A1 Jan. 7, 2010

(30) Foreign Application Priority Data

Dec. 14, 2005 (JP) ..... 2005-360005

(51) Int. Cl.
*B32B 37/00* (2006.01)

(52) U.S. Cl. ..... 264/45.4; 425/4 R

(58) Field of Classification Search ..... 264/45.4; 425/4 R

See application file for complete search history.

(56) References Cited

U.S. PATENT DOCUMENTS

| | | | | |
|---|---|---|---|---|
| 3,810,728 | A * | 5/1974 | Jacobs | 425/547 |
| 2003/0026866 | A1 * | 2/2003 | Boyd | 425/190 |
| 2006/0071364 | A1 * | 4/2006 | Zenpo et al. | 264/219 |

FOREIGN PATENT DOCUMENTS

| | | | |
|---|---|---|---|
| EP | 1 561 527 | A1 | 8/2005 |
| EP | 1 749 598 | A1 | 2/2007 |
| WO | WO 2004/041460 | A1 | 5/2004 |
| WO | WO 2005/089984 | A1 | 9/2005 |

* cited by examiner

*Primary Examiner* — Joseph S Del Sole
*Assistant Examiner* — David N Brown, II
(74) *Attorney, Agent, or Firm* — Finnegan, Henderson, Farabow, Garrett & Dunner, L.L.P.

(57) ABSTRACT

A method for filling a foam mixture in a cavity of a metal mold, which can provide a mold without defects. This method for filling a foam mixture in a cavity of a horizontally-split metal mold by pressurizing a mixture of granular aggregate, water-soluble binders, and water, and injecting the mixture into the cavity of the metal mold includes: a step for preparing the horizontally-split metal mold having a filling port communicating with the cavity, which port is disposed at a side and near abutting surfaces of the horizontally-split metal mold; a step for connecting a discharging port of a device for injecting the foam mixture to the filling port of the horizontally-split metal mold, wherein the device for injecting the foam mixture includes a mixing bath to accommodate and mix the granular aggregate, the water-soluble binders, and the water, and a mechanism for pushing up the mixture in the mixing bath, wherein the mixing bath is cylindrical and has an opening at its upper end, a bottom plate at its lower end, and the discharging port at its side; a step for pushing up the foam mixture in the mixing bath by driving the mechanism for pushing up the mixture; a step for discharging the foam mixture from the discharging port, and for injecting the mixture into the filling port; and a step for filling the cavity with the foam mixture while the mixture pushes out air in the cavity.

11 Claims, 4 Drawing Sheets

METHOD FOR FILLING A FOAM MIXTURE IN A CAVITY OF A METAL MOLD AND AN APPARATUS FOR MOLDING A MOLD

TECHNICAL FIELD

This invention relates to a method for filling a foam mixture in a cavity of a metal mold and an apparatus for molding a mold. Particularly, it relates to a method for filling a foam mixture composed of a mixture of granular aggregate, water-soluble binders, and water in a horizontally-split or a vertically-split metal mold, by pressurizing and injecting it into the cavity of the metal mold. This invention also relates to an apparatus for molding a mold using this method.

BACKGROUND OF THE INVENTION

This applicant has already provided an apparatus for molding a mold.

The apparatus can mold a mold by pressurizing a foam mixture composed of granular aggregate, water-soluble binders, and water, and injecting it into a cavity of a heated metal mold. The apparatus is comprised of:

a hollow rectangular-parallelepiped body having a bottom plate disposed at a lower opening of the body, the bottom plate having an injection hole to inject the foam mixture, a means for containing the foam mixture having functions as a mixing bath to mix granular aggregate, water-soluble binders, and water, and as a pressurized vessel to inject the foam mixture into a metal mold, and a means for closing and opening the injection hole.

Patent document 1: International Patent Laid-open Publication No. WO 2005/089984 A1

In this conventional apparatus for molding a mold, there is a problem in that when the foam mixture is pressurized and injected into the cavity of the metal mold, air in the cavity causes defects in the mold.

This invention intends to solve that problem. Namely, the purpose of this invention is to provide a method for filling a foam mixture in a cavity of a metal mold without causing defects in the mold, and to provide an apparatus for molding a mold by using the method.

SUMMARY OF THE INVENTION

To solve the above problem, the method of the invention has the following features:

A method for filling a foam mixture in a cavity of a horizontally-split metal mold by pressurizing the mixture composed of granular aggregate, water-soluble binders, and water, and injecting the mixture into the cavity of the metal mold, the method comprising:

a step for preparing the horizontally-split metal mold having a filling port communicating with the cavity, which port is disposed at a side and near abutting surfaces of the horizontally-split metal mold, a step for connecting a discharging port of a means for injecting the foam mixture to the filling port of the horizontally-split metal mold, wherein the means for injecting the foam mixture comprises a mixing bath to accommodate and mix the granular aggregate, the water-soluble binders, and the water, and a mechanism for pushing up the mixture in the mixing bath, wherein the mixing bath is cylindrical and has an opening at its upper end, a bottom plate at its lower end, and the discharging port at its side, a step for pushing up the foam mixture in the mixing bath by driving the mechanism for pushing up the mixture, a step for discharging the foam mixture from the discharging port, and for injecting the mixture into the filling port, and a step for filling the cavity with the foam mixture while the mixture pushes out air in the cavity.

The method of also has the following features.

A method for filling a foam mixture in a cavity of a vertically or horizontally-split metal mold by pressurizing the mixture composed of granular aggregate, water-soluble binders, and water, and injecting the mixture into the cavity of the metal mold, the method comprising:

a step for preparing the vertically-split metal mold having a filling port communicating with the cavity, which port is disposed near the lower portion of its abutting surface, or the horizontally-split metal mold having a filling port communicating with the cavity, which port is disposed at its bottom surface, a step for connecting an opening of a means for injecting the foam mixture to the filling port of the vertically or horizontally-split metal mold, wherein the means for injecting the mixture comprises a mixing bath to accommodate and mix the granular aggregate, the water-soluble binders, and the water, and a mechanism for pushing up the mixture in the mixing bath, wherein the mixing bath is cylindrical and has an opening at its upper end and a bottom plate at its lower end, a step for pushing up the foam mixture in the mixing bath by driving the mechanism for pushing up the mixture, a step for injecting the foam mixture into the filling port, and a step for filling the cavity with the foam mixture while the mixture pushes out air in the cavity.

For the present invention, when the discharging port of the means for injecting the foam mixture is connected to the filling port of the horizontally-split metal mold, it is preferable to connect them by horizontally moving the means for injecting the mixture. Further, when the opening of the means for injecting the foam mixture is connected to the filling port of the vertically-split metal mold, it is preferable to connect them by horizontally and vertically moving the means for injecting the mixture.

For the present invention, it is preferable to heat the horizontally or vertically-split metal mold by an electrical heater.

Since the invention of has the following features, a method for filling a foam mixture in a cavity of a horizontally-split metal mold by pressurizing the mixture composed of granular aggregate, water-soluble binders, and water, and injecting the mixture into the cavity of the metal mold, the method comprising:

a step for preparing the horizontally-split metal mold having a filling port communicating with the cavity, which port is disposed at a side and near abutting surfaces of the horizontally-split metal mold, a step for connecting a discharging port of a means for injecting the foam mixture to the filling port of the horizontally-split metal mold, wherein the means for injecting the foam mixture comprises a mixing bath to accommodate and mix the granular aggregate, the water-soluble binders, and the water, and a mechanism for pushing up the mixture in the mixing bath, wherein the mixing bath is cylindrical and has an opening at its upper end, a bottom plate at its lower end, and the discharging port at its side.

a step for pushing up the foam mixture in the mixing bath by driving the mechanism for pushing up the mixture, a step for discharging the foam mixture from the discharging port, and for injecting the mixture into the filling port, and a step for filling the cavity with the foam mixture while the mixture pushes out air in the cavity, the invention can prevent an unfilled portion of the foam mixture from being formed in the cavity. Namely, this invention has an excellent effect. That is, it prevents a mold with defects in its inside from forming.

Since the invention of also has the following features, i.e., a method for filling a foam mixture in a cavity of a vertically or horizontally-split metal mold by pressurizing the mixture, which is composed of granular aggregate, water-soluble binders, and water, and injecting the mixture into the cavity of the metal mold, the method comprising:

a step for preparing the vertically-split metal mold having a filling port communicating with the cavity, which port is disposed near the lower portion of its abutting surface, or the horizontally-split metal mold having a filling port communicating with the cavity, which port is disposed at its bottom surface, a step for connecting an opening of a means for injecting the foam mixture into the filling port of the vertically or horizontally-split metal mold, wherein the means for injecting the mixture comprises a mixing bath to accommodate and mix the granular aggregate, the water-soluble binders, and the water, and a mechanism for pushing up the mixture in the mixing bath, wherein the mixing bath is cylindrical and has an opening at its upper end and a bottom plate at its lower end, a step for pushing up the foam mixture in the mixing bath by driving the mechanism for pushing up the mixture, a step for injecting the foam mixture into the filling port, and a step for filling the cavity with the foam mixture while the mixture pushes out air in the cavity, the invention can prevent an unfilled portion of the foam mixture from being formed in the cavity. Namely, this invention has an excellent effect. That is, it prevents a mold having defects inside it from forming.

PREFERRED EMBODIMENTS OF THE INVENTION

Figure 1:
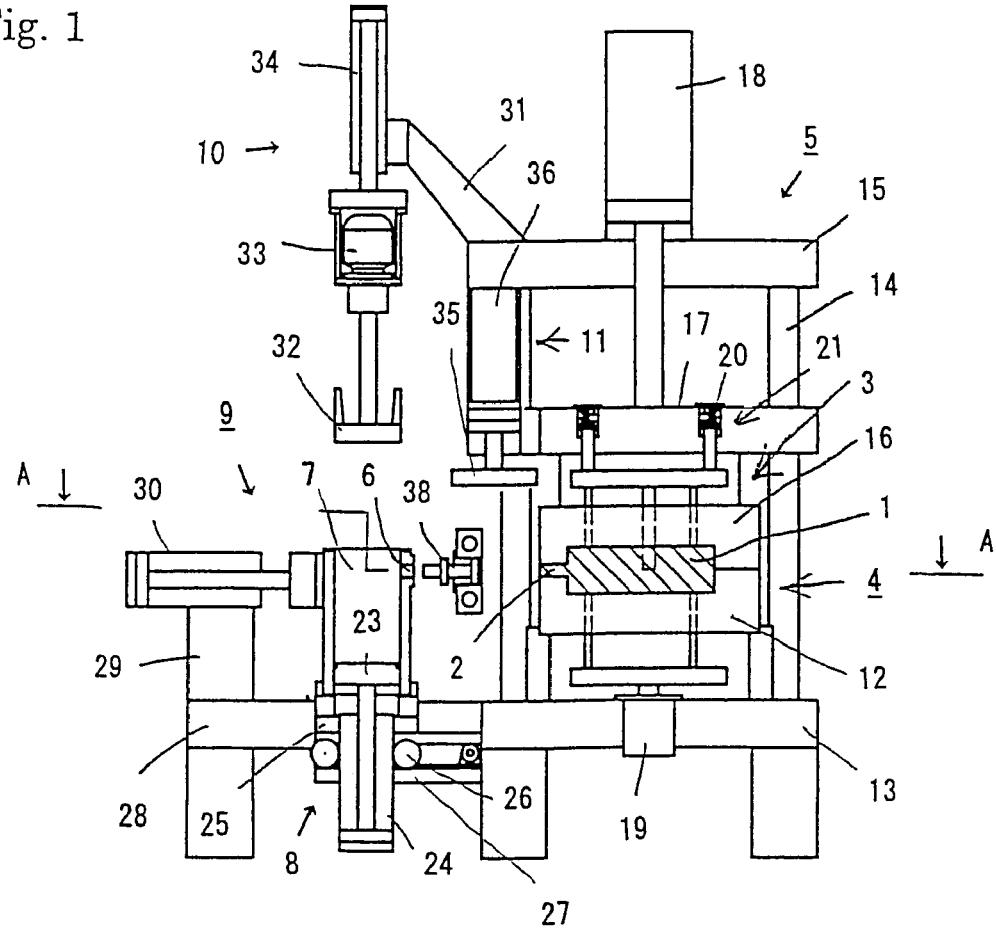
FIG. 1 shows an elevational view and a partial sectional view of an apparatus for molding a mold. It is an embodiment to execute the method of the invention.

Below, the details of one embodiment of the apparatus for molding a mold used for executing the method of the invention of is explained based on FIGS. 1 and 2. As they show, the apparatus for molding a mold comprises:

a horizontally-split metal mold 4 comprising a filling port 2 communicating with a cavity 1, which port is disposed at the left side of an abutting surface of the metal mold 4, and a mechanism 3 for pushing a mold out, a mechanism 5 for opening and closing the horizontally-split metal mold 4, a means 9 for injecting a foam mixture comprising a mixing bath 7 to accommodate and mix granular aggregate, water-soluble binders, and water, and a mechanism 8 for pushing up the mixture in the mixing bath 7, wherein the mixing bath 7 is cylindrical and has an opening at its upper end, a bottom plate 23 at its lower end, and a discharging port 6 to discharge the mixture at its side, and wherein the discharging port 6 can be connected to the filling port 2 of the horizontally-split metal mold 4.

a means 10 for mixing the granular aggregate, the water-soluble binders, and the water accommodated in the mixing bath 7 of the means 9 for injecting the mixture, wherein the means 10 for mixing the mixture is disposed at a location that is apart from the mixing bath 7, and a means 11 for closing the opening disposed at the upper end of the mixing bath 7 of the means 9 for injecting the mixture, wherein the means 11 for closing the opening is disposed at a location that is apart from the mixing bath 7, wherein the horizontally-split metal mold 4 can be heated by an electrical heater.

The mechanism 5 for opening and closing the horizontally-split metal mold 4 comprises:

a base 13 supporting a lower mold 12 of the horizontally-split metal mold 4 on its upper surface, four guide rods 14, 14 disposed at the four corners of the upper surface of the base 13, an upper frame 15 connected to the upper ends of the guide rods 14, 14, an ascending and descending frame 17 holding an upper mold 16 of the horizontally-split metal mold 4 at its lower surface, wherein the frame 17 can slidably move up and down along the guide rods 14, 14, and a cylinder 18 extending downward and disposed at the central portion of the upper surface of the upper frame 15, wherein the lower end of the piston rod of the cylinder 18 is connected to the central portion of the upper surface of the ascending and descending frame 17.

The upper mold 16 of the horizontally-split metal mold 4 can be lowered and lifted by the extending and contracting movement of the cylinder 18 by means of the ascending and descending frame 17.

Further, a cylinder 19, extending upward, is disposed at the central portion of the base 13. The cylinder 19 can push up the lower portion of the mechanism 3 for pushing a mold out.

Further, a mechanism 21 for pushing the mechanism 3 down is disposed at the ascending and descending frame 17. The mechanism 21 comprises a plurality of compression coil springs 20, 20 to push down the upper portion of the mechanism 3.

The mechanism 8 for pushing up the foam mixture of the means 9 for injecting the mixture comprises a bottom plate 23 disposed in the mixing bath 7, which plate 23 can slidably move up and down, and a cylinder 24 extending upward and disposed at the bottom portion of the mixing bath 7, wherein the upper end of the piston rod of the cylinder 24 is connected to the lower surface of the bottom plate 23.

The means 9 for injecting the foam mixture is disposed at the left side of the horizontally-split metal mold 4, and can move to the right by means of a carrier 25. The carrier 25 can move on a pair of horizontal rails 27 by means of a plurality of wheels 26, 26 having a V-shaped groove. The pair of rails 27 are disposed at a side base 28, which is located at the left side of the base 13. Further, a horizontal cylinder 30 is disposed on the side base 28 by means of a supporting member 29. The distal end of the piston rod of the cylinder 30 is connected to the left outer side of the mixing bath 7. The means 9 for injecting the foam mixture can horizontally reciprocate by the extending and contracting movements of the cylinder 30.

The means 10 for mixing the foam mixture is disposed above the means 9 for injecting the mixture by means of a supporting member 31. It is disposed at the upper frame 15 of the mechanism 5 for opening and closing the metal mold 4. The means 10 comprises mixing blades 32, a downward-facing motor 33 to rotate the mixing blades 32, and a cylinder 34 extending downward to lift and lower the motor 33.

The means 11 for closing the opening of the mixing bath 7 is disposed above the means 9 for injecting the foam mixture by attaching the means 11 to the lower surface of the upper frame 15 of the mechanism 5 for opening and closing the metal mold 4. The means 11 comprises a lid 35, and a cylinder 36 extending downward to lift and lower the lid 35.

Figure 2:
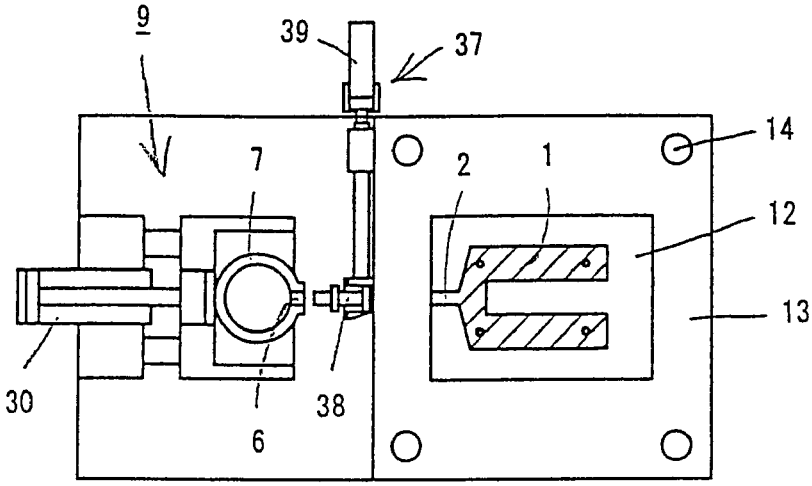
FIG. 2 shows a cross sectional view at line A-A in FIG. 1.

As shown in FIG. 2, a plugging means 37 for closing the discharging port 6 of the mixing bath 7 is disposed between the horizontally-split metal mold 4 and the means 9 for injecting the foam mixture. The plugging means 37 comprises a plug 38 that is comprised of a horizontal cylinder, and another horizontal cylinder 39. The piston rod of the cylinder of the plug 38 is insertable in the discharging port 6. The plug 38 is connected to the distal end of the piston rod of the cylinder 39.

Below, the processes for molding a mold are explained based on FIG. 1, which shows the initial state of the apparatus. After preheating the upper and the lower mold 16, 12 of the horizontally-split metal mold 4 up to a predetermined temperature, the granular aggregate, the water-soluble binders, and the water are charged in the mixing bath 7 of the means 9 for injecting a foam mixture. Then, the piston rod of the plug 38 of the plugging means 37 is inserted into the discharging port 6 of the mixing bath 7. Next, the mixing blades 32 are inserted into the mixing bath 7 by extending the cylinder 34 of the means 10 for mixing the foam mixture. The granular aggregate, the water-soluble binders, and the water are mixed by rotating the mixing blades 32 by means of the motor 33, to form the foam mixture. After mixing them, the motor 33 is stopped. Then, the mixing blades 32 are lifted up by contracting the cylinder 34. Next, after the piston rod of the plug 38 is removed from the discharging port 6, the plug 38 is taken out from between the horizontally-split metal mold 4 and the means 9 for injecting a foam mixture, by contracting the cylinder 39 of the plugging means 37. Next, the means 9 for injecting a foam mixture is moved to the right by extending the cylinder 30, and then the discharging port 6 of the mixing bath 7 is connected to the filling port 2 of the horizontally-split metal mold 4. Then the opening disposed at the upper surface of the mixing bath 7 is closed by the lid 35 by extending the cylinder 36.

Next, the bottom plate 23 of the mechanism 8 for pushing up the foam mixture is lifted by extending the cylinder 24. By the movement of the bottom plate, the foam mixture is discharged from the discharging port 6 and injected into the cavity 1 of the horizontally-split metal mold 4 through its filling port 2. The cavity 1 of the metal mold 4 is filled with the foam mixture while the mixture presses out the air in the cavity 1 through the abutting surface of the upper and the lower mold 16, 12 of the metal mold 4, and through a clearance between the upper and the lower mold 16, 12 and the pushing rods of the mechanism 3 for pushing a mold out. After the foam mixture in the cavity 1 has hardened by the heat of the horizontally-split metal mold 4, the upper mold 16 is separated from the lower mold 12, and lifted by contracting the cylinder 18 of the mechanism 5 for opening and closing the horizontally-split metal mold 4. Then, by the action of the compression coil springs 20, 20 of the mechanism 21 for pushing the mechanism 3 down, the upper portion of the mechanism 3 for pushing a mold out is lowered. The hardened foam mixture is separated from the upper mold 16 and placed on the lower mold 12. Next, the lower portion of the mechanism 3 for pushing the mold out is lifted by extending the cylinder 19. By the action of the lower portion of the mechanism 3, the hardened foam mixture is separated from the lower mold 12 and lifted up. Based on the procedures explained in the above paragraphs, a required mold can be produced.

Figure 3:
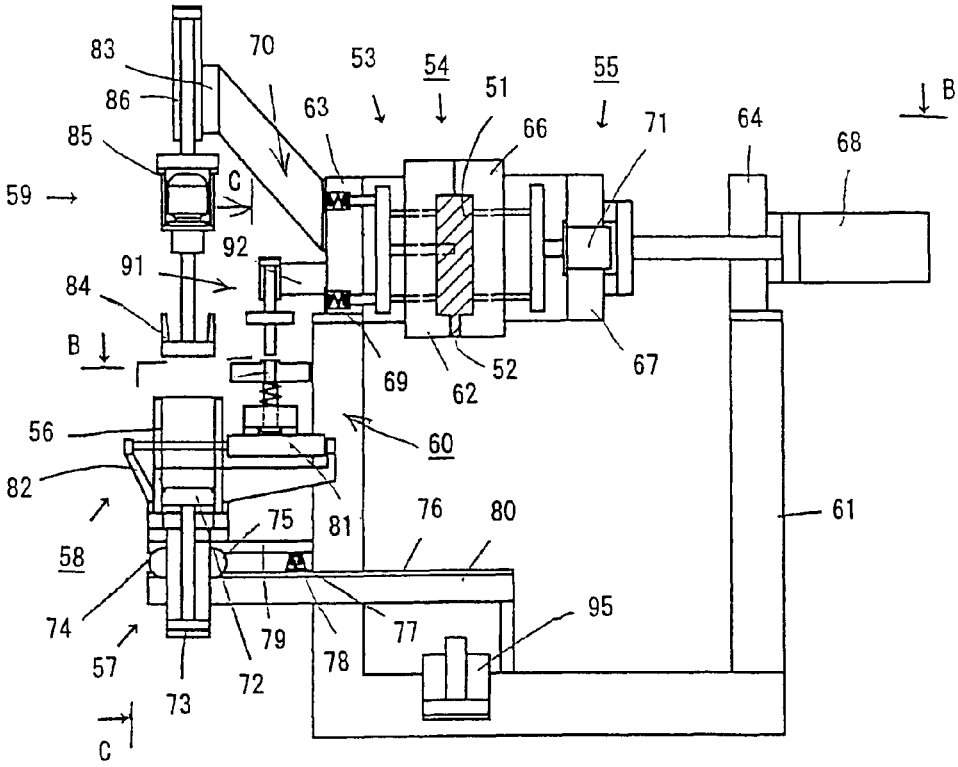
FIG. 3 shows an elevational view and a partial sectional view of an apparatus for molding a mold. It is a further embodiment to execute the method of the invention.
Figure 4:
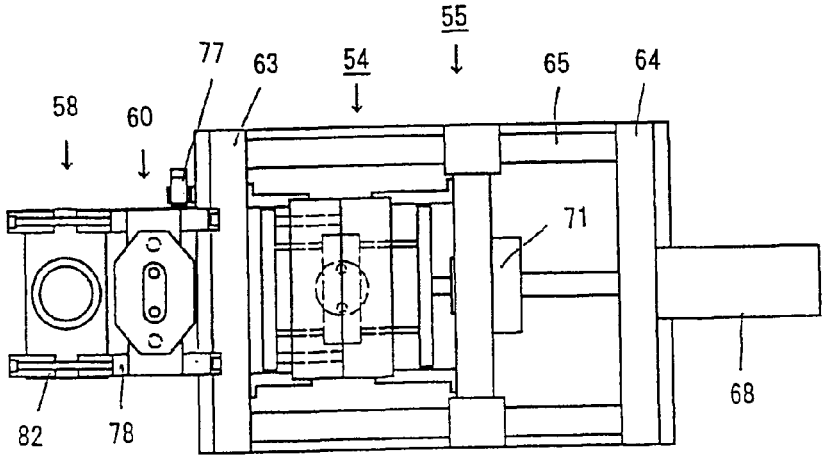
FIG. 4 shows a cross sectional view at line B-B in FIG. 3.
Figure 5:
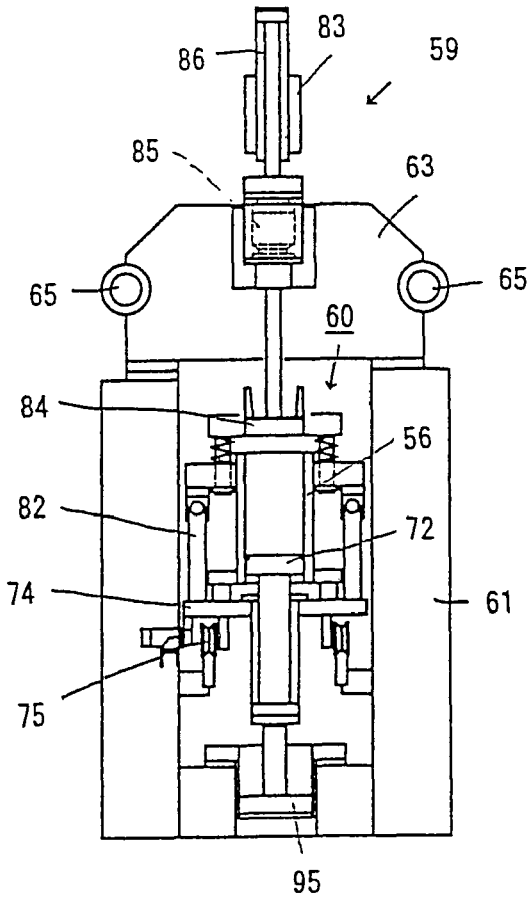
FIG. 5 shows a partial left side view of FIG. 3.

Below, the details of another embodiment of the apparatus for molding a mold used for executing the method of the invention is explained based on FIGS. 3-6. As shown in FIGS. 3, 4, and 5, the apparatus for molding a mold comprises:

a vertically-split metal mold 54 comprising filling ports 52 communicating with a cavity 51, which ports are disposed at a lower side of an abutting surface of the metal mold 54, and a mechanism 53 for pushing a mold out, a mechanism 55 for opening and closing the vertically-split metal mold 54, a means 58 for injecting a foam mixture comprising a mixing bath 56 to accommodate and mix granular aggregate, water-soluble binders, and water, and a mechanism 57 for pushing up the mixture in the mixing bath 56, wherein the mixing bath 56 has a cylindrical shape having an opening at its upper end, and a bottom plate 72 at its lower end, and wherein the opening of the mixing bath 56 can be connected to the filling ports 52 of the vertically-split metal mold 54.

a means 59 for mixing the granular aggregate, the water-soluble binders, and the water accommodated in the mixing bath 56 of the means 58 for injecting the mixture, wherein the means 59 for mixing the mixture is disposed at a location that is apart from the mixing bath 56, and a means 60 for connecting the opening of the mixing bath 56 of the means 58 for injecting the mixture to the filling ports 52 of the vertically-split metal mold 54, wherein the means 60 is disposed at a location that is apart from the mixing bath 56, wherein the vertically-split metal mold 54 can be heated by an electrical heater.

As shown in FIG. 3, the mechanism 55 for opening and closing the vertically-split metal mold 54 comprises:

a base 61 having a U-shaped structure, a fixed die base 63 disposed at a top surface of the left portion of the base 61, wherein a left mold 62 of the vertically-split metal mold 54 is attached to the fixed die base 63, a frame 64 disposed at a top surface of the right portion of the base 61, two tying bars 65, 65 extending between the fixed die base 63 and the frame 64, wherein the two tying bars are disposed with a predetermined interval in the front-rear direction, and face each other, a movable die base 67 slidably disposed at the two tying bars 65, 65, wherein a right mold 66 of the vertically-split metal mold 54 is attached to the movable die base 67, and a horizontal cylinder 68 disposed at the center portion of the frame 64 for reciprocating the movable die base 67, wherein the right mold 66 of the vertically-split metal mold 54 can reciprocate horizontally by extending and contracting the cylinder 68 by means of the movable die base 67.

The mechanism 70 is disposed at the fixed die base 63 for pushing the left portion of the mechanism 53, for pushing a mold out, by means of compression coil springs 69, 69. Further, a horizontal cylinder 71 is disposed at the central portion of the movable die base 67 for pushing the right portion of the mechanism 53, for pushing a mold out.

As shown in FIG. 3, the mechanism 57 for pushing up the foam mixture of the means 58 for injecting the mixture comprises a bottom plate 72 disposed in the mixing bath 56, which plate 72 can slidably move up and down, and a cylinder 73 extending upward and disposed at the bottom portion of the mixing bath 56, wherein the upper end of the piston rod of the cylinder 73 is connected to the lower surface of the bottom plate 72.

The means 58 for injecting the foam mixture can move under the vertically-split metal mold 54 by means of a carrier 74. The carrier 74 can move on a pair of horizontal rails 76 by means of a plurality of wheels 75, 75, each having a V-shaped groove. The carrier 74 is driven by means of a rack and pinion mechanism, wherein the pinion is attached to an output shaft of a motor, and wherein the rack is disposed at the carrier 74. The pair of rails 76, 76 are disposed at a side base 80, which is located at the left side of the base 61. Two special cylinders 81, 81 are disposed at the upper surface and both sides of the carrier 74 by means of supporting members 82, 82. The main bodies of the special cylinders 81, 81 can be reciprocated horizontally.

As shown in FIG. 3, the means 59 for mixing the foam mixture is disposed above the means 58 for injecting the mixture by means of a supporting member 83. The supporting member 83 is disposed at the fixed die base 63 of the mechanism 55 for opening and closing the vertically-split metal mold 54. The means 59 comprises mixing blades 84, a downward-facing motor 85 to rotate the mixing blades 84, and a cylinder 86 extending downward to lift and lower the motor 85.

Figure 6:
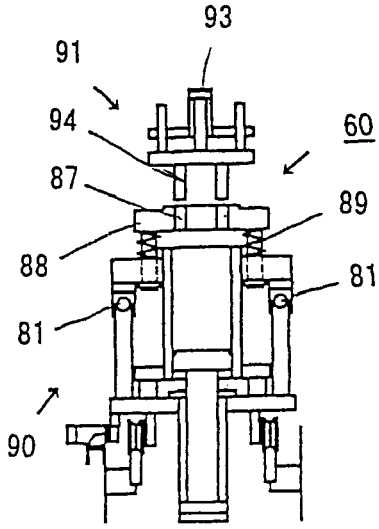
FIG. 6 shows a partial cross sectional view at line C-C in FIG. 3.

As shown in FIG. 6, the means 60 for connecting the opening of the mixing bath 56 to the filling ports 52 of the vertically-split metal mold 54 comprises:

a main structure 88 having communicating holes 87 vertically extending and passing through it, and a supporting structure 90 that is disposed between the main bodies of the two special cylinders 81, 81, and that supports the main structure 88 by means of coil springs 89, 89.

As shown in FIG. 3, the means 60 can independently and horizontally reciprocate by the movement of the special cylinders 81, 81.

As shown in FIG. 3, a means 91 for cleaning the communicating holes 87 of the main structure 88 of the connecting means 60 is disposed above the connecting means 60 by means of a supporting structure 92 attached to the fixed die base 63. As shown in FIG. 6, the means 91 for cleaning the communicating holes 87 comprises a cylinder 93 extending downward, and cleaning rods 94 fixed to the distal end of the piston rod of the cylinder 93.

Further, as shown in FIG. 3, a cylinder 95, extending upward, is disposed below the means 58 for injecting the mixture and just under the vertically-split metal mold 54 to push up the injecting means 58 and the connecting means 60 and to abut the connecting means 60 at the lower surface of the metal mold 54.

Below, the processes for molding a mold are explained based on FIG. 3. It shows the initial state of the apparatus. After preheating the left and the right mold 62, 66 of the vertically-split metal mold 54 up to predetermined temperature, the granular aggregate, the water-soluble binders, and the water are charged in the mixing bath 56 of the means 58 for injecting a foam mixture. Then, the mixing blades 84 are inserted into the mixing bath 56 by extending the cylinder 86 of the means 59 for mixing the foam mixture. The granular aggregate, the water-soluble binders, and the water are mixed by rotating the mixing blades 84 by means of the motor 85, to form the foam mixture. After mixing them, the motor 85 is stopped. Then, the mixing blades 84 are lifted up by contracting the cylinder 86. Next, the means 58 for injecting a foam mixture is moved under the vertically-split metal mold 54 by means of the carrier 74 by forwardly driving the motor 77. The means 60 for connecting the opening of the mixing bath 56 to the filling ports 52 of the vertically-split metal mold 54 is also moved to the right. Then, the connecting means 60 is further moved by the movement of the special cylinders 81, 81 so that the communicating holes 87 of the main structure 88 of the connecting means 60 come to just under the filling ports 52 of the metal mold 54.

The means 58 for injecting a foam mixture and the main structure 88 of the means 60 for connecting the opening of the mixing bath 56 to the filling ports 52 of the vertically-split metal mold 54 are lifted by extending the cylinder 95. Then, the opening of the mixing bath 56 of the means 58 for injecting a foam mixture is connected to the filling ports 52 through the main structure 88 Next, the bottom plate 72 of the mechanism 57 for pushing up the foam mixture is lifted by extending the cylinder 73. By the movement of the bottom plate, the foam mixture is discharged from the opening of the mixing bath 56 and injected into the cavity 51 of the vertically-split metal mold 54 though its filling ports 52. The cavity 51 of the method mold 54 is filled with the foam mixture while the mixture presses out the air in the cavity 51 through the abutting surface of the left and the right mold 62, 66 of the metal mold 54, and through a clearance between the left and the right mold 62, 66 and the pushing rods of the mechanism 53 for pushing a mold out. After the cavity 51 is filled with the foam mixture, the means 58 for injecting a foam mixture and the main structure 88 are lowered by contracting the cylinder 95. Then, the injecting means 58 and the connecting means 60 are returned to the initial position shown by FIG. 3 by means of the carrier 74 by reversely driving the motor 77.

After the foam mixture in the cavity 51 has hardened by the heat of the vertically-split metal mold 54, the right mold 66 is separated from the left mold 62 by contracting the cylinder 68. Then, the left portion of the mechanism 53 for pushing a mold out is pushed by the compression coil springs 69, 69 of the mechanism 70. By the movement of the left portion of the mechanism 53, the hardened foam mixture is pushed out of the left mold 62 while it remains in the right mold 66. Next, by pushing the right portion of the mechanism 53 by extending the cylinder 71, the hardened foam mixture is separated from the left mold 62. Based on the processes explained above, a desired mold can be produced.

Figure 7:
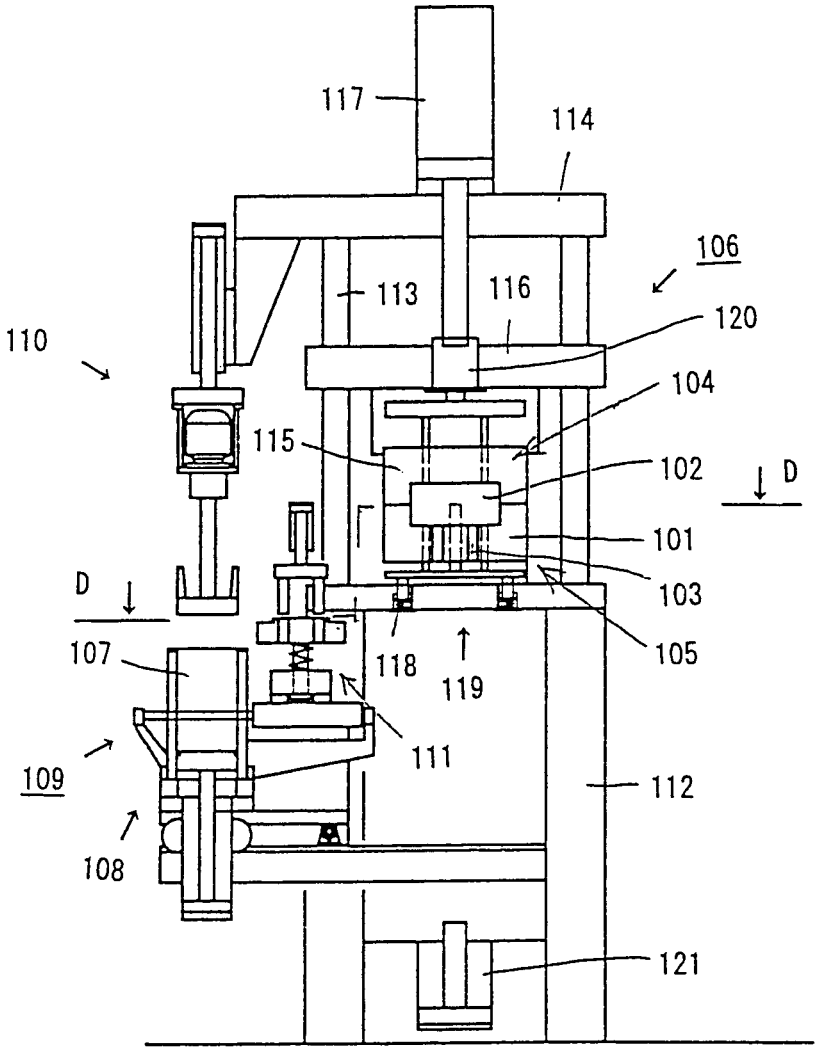
FIG. 7 shows an elevational view and a partial sectional view of an apparatus for molding a mold. It is another embodiment to execute the method of the invention.
Figure 8:
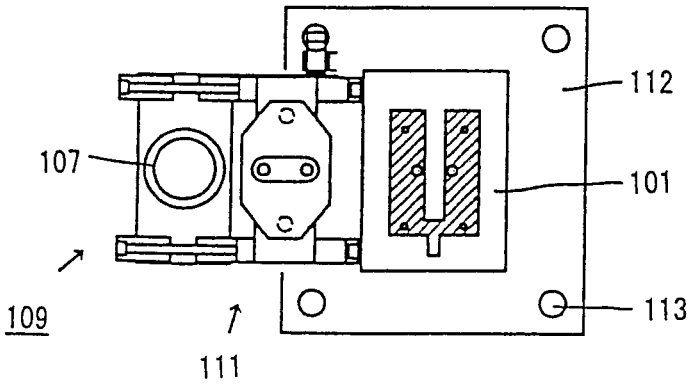
FIG. 8 shows a partial cross sectional view at line D-D in FIG. 7.

For the embodiment explained in the above paragraphs, although the vertically-split metal mold 54 is used as a metal mold, the horizontally-split metal mold can also bring about the same effects as those produced by the vertically-split metal mold. Namely, as shown in FIGS. 7 and 8, an apparatus for molding a mold comprises:

a horizontally-split metal mold 105 comprising a plurality of filling ports 103 communicating with the cavity 102, which ports are disposed at the lower surface of a lower mold 101, and a mechanism 104 for pushing a mold out, wherein the horizontally-split metal mold 105 can be heated, a mechanism 106 for opening and closing the horizontally-split metal mold 105, a means 109 for injecting a foam mixture comprising a mixing bath 107 to accommodate and mix granular aggregate, water-soluble binders, and water, and a mechanism 108 for pushing up the mixture in the mixing bath 107, wherein the mixing bath 107 has a cylindrical shape having an opening at its upper end and a bottom plate at its lower end, and wherein the opening of the mixing bath 107 can be connected to the filling ports 103 of the horizontally-split metal mold 105, a means 110 for mixing the granular aggregate, the water-soluble binders, and the water accommodated in the mixing bath 107 of the means 109 for injecting the mixture, wherein the means 110 is disposed at a location that is apart from the mixing bath 107, and a means 111 for connecting the opening of the mixing bath 107 of the means 109 for injecting the mixture to the filling ports 103 of the horizontally-split metal mold 105, wherein the means 111 is disposed at a location that is apart from the mixing bath 7.

The mechanism 106 for opening and closing the horizontally-split metal mold 105 comprises:

a base 112 supporting on its upper surface a lower mold 101 of the horizontally-split metal mold 105, four guide rods 113, 113 disposed at four respective corners of the upper surface of the base 112, an upper frame 114 connected to the upper ends of the guide rods 113, 113, an ascending and descending frame 116 holding an upper mold 115 of the horizontally-split metal mold 105 at its lower surface, wherein the frame 116 can slidably move up and down along the guide rods 113, 113, and a cylinder 117 extending downward and disposed at the central portion of the upper surface of the upper frame 114, wherein the lower end of the piston rod of the cylinder 117 is connected to the central portion of the upper surface of the ascending and descending frame 116.

The upper mold 115 of the horizontally-split metal mold 105 can be lowered and lifted by the extending and contracting movements of the cylinder 117 by means of the ascending and descending frame 116.

Further, a mechanism 119 for pushing up the mechanism 104 for pushing a mold out is disposed at the base 112. The mechanism 119 can push up the lower portion of the mechanism 104 by means of a plurality of compression coil springs 118, 118. A cylinder 120 extending downward is disposed at the central portion of the ascending and descending frame 116. The cylinder 120 can push down the upper portion of the mechanism 104.

Further, a cylinder 121, extending upward, is disposed below the means 109 for injecting the mixture and just under the horizontally-split metal mold 105 to push up the injecting means 109 and the connecting means 111 and to abut the connecting means 111 at the lower surface of the metal mold 105.

The means 109 for injecting the foam mixture, the means 110 for mixing the form mixture, and the means 111 for connecting the opening of the mixing bath 107 to the filling ports 103, have the same features and functions as those of the injecting means 58, the mixing means 59, and the connecting means 60, respectively. Thus, the detailed explanations of these means are omitted.

Below, the processes for molding a mold, which processes use the apparatus explained in the above paragraphs, are explained. After preheating the upper and the lower mold 115, 101 of the horizontally-split metal mold 105 up to a predetermined temperature, the granular aggregate, the water-soluble binders, and the water are charged in the mixing bath 107 of the means 109 for injecting the foam mixture. Then, the granular aggregate, the water-soluble binders, and the water are mixed in the same way as explained in the embodiment that uses a vertically-split metal mold 54. After mixing them, the means 109, for injecting the foam mixture, and the means 111, for connecting the opening of the mixing bath 107 to the filling ports 103, are moved to a position which is below the horizontally-split metal mold 105. Then, the means 111 are moved to just under the metal mold 105. Next, by extending the cylinder 121, the opening of the mixing bath 107 of the means 109 for injecting the foam mixture is connected to the filling ports 103 of the metal mold 105 through the connecting means 111. Then, the foam mixture is injected into the cavity 102 of the metal mold 105 by means of the means 109 for injecting the foam mixture. The cavity 102 is filled with the foam mixture while the mixture presses out the air in the cavity 102 through the abutting surface of the upper and the lower mold 115, 101 of the metal mold 105, and through a clearance between the upper and the lower mold 115, 101 and the pushing rods of the mechanism 104 for pushing out a mold.

After the cavity 102 is filled with the foam mixture, the means 109 for injecting a foam mixture and the means 111 for connecting the opening of the mixing bath 107 to the filling ports 103 are lowered by contracting the cylinder 121. Then, the injecting means 109 and the connecting means 111 are returned to the initial position.

After the foam mixture in the cavity 102 has hardened by means of the heat of the horizontally-split metal mold 105, the upper mold 115 is separated from the lower mold 101 by contracting the cylinder 117. Then, the lower portion of the mechanism 104 for pushing a mold out is pushed by the compression coil springs 118 of the mechanism 119 for pushing up the mechanism 104. By the movement of the lower portion of the mechanism 104, the hardened foam mixture is pushed out of the lower mold 101 while it remains in the upper mold 115. Next, by pushing the upper portion of the mechanism 104 by extending the cylinder 120, the hardened foam mixture is separated from the upper mold 115. Based on the processes explained above, a desired mold can be produced.

What we claim is:

1. A method for filling a foam mixture in a cavity of a horizontally-split metal mold by pressurizing a foamed mixture including granular aggregate, water-soluble binders, and water, and injecting the mixture into a cavity of the metal mold, the method comprising:

providing a horizontally-split metal mold having a filling port communicating with a cavity therein, which port is disposed at a side and near abutting surfaces of the horizontally-split metal mold;

charging granular aggregate, water-soluble binders and water to a mixing bath through an opening thereof;

inserting mixing blades into the mixing bath;

mixing the granular aggregate, the water-soluble binders and the water by rotating the mixing blades to form a foam mixture;

removing the mixing blades from the mixing bath;

connecting a discharging port of the mixing bath to the filling port of the horizontally-split metal mold;

closing the opening of the mixing bath;

pushing up the foam mixture in the mixing bath to pressurize and discharge the foam mixture from the discharging port of the mixing bath, and inject the foam mixture into the filling port of the horizontally-split metal mold; and filling the cavity of the mold with the foam mixture while the mixture pushes out air in the cavity.

2. A method for filling a foam mixture in a cavity of a vertically- or horizontally-split metal mold by pressurizing a foamed mixture including granular aggregate, water-soluble binders, and water, and injecting the mixture into a cavity of the metal mold, the method comprising:

providing a vertically-split metal mold having a filling port communicating with a cavity therein, which port is disposed near a lower portion of abutting surfaces thereof, or providing a horizontally-split metal mold having a filling port communicating with a cavity therein, which port is disposed at a bottom surface thereof;

charging granular aggregate, water-soluble binders, and water to a mixing bath through an opening thereof;

inserting mixing blades into the mixing bath;

mixing the granular aggregate, the water-soluble binders and the water by rotating the mixing blades to form a foam mixture;

removing the mixing blades from the mixing bath;

closing the opening of the mixing bath with a connector means;

connecting the opening of the mixing bath to the filling port of the vertically- or horizontally-split metal mold with the connecting means;

pushing up the foam mixture in the mixing bath to pressurize and inject the foam mixture into the filling port of the vertically- or horizontally-split metal mold; and filling the cavity of the metal mold with the foam mixture while the mixture pushes out air in the cavity.

3. An apparatus for molding a mold, the apparatus comprising:

a horizontally-split metal mold having a filling port communicating with a cavity therein, which port is disposed at a side and near abutting surfaces of the horizontally-split metal mold;

a mechanism for pushing out a mold formed in the metal mold;

means for heating the horizontally-split metal mold;

a mechanism for opening and closing the horizontally-split metal mold;

means for injecting a foam mixture including a mixing bath to accommodate and mix granular aggregate, water-soluble binders, and water, and a pushing mechanism for pushing up the mixture in the mixing bath, wherein the mixing bath is cylindrical and has an opening at an upper end thereof, a bottom plate at a lower end thereof that can be pushed up by pushing mechanism, and a discharging port to discharge the mixture at a side thereof, and wherein the discharging port can be connected to the filling port of the horizontally-split metal mold;

means for mixing the granular aggregate, water-soluble binders, and the water in the mixing bath of the means for injecting the foam mixture to form a foam mixture, wherein the means for mixing the foam mixture can be inserted into and removed from the mixing bath; and means for closing the opening at the upper end of the mixing bath, wherein the means for closing the opening is disposed at a location that is apart from the mixing bath.

4. An apparatus for molding a mold, the apparatus comprising:

a vertically-split metal mold having filling ports communicating with a cavity therein, which ports are disposed at a lower side of abutting surfaces of the vertically-split metal mold;

a mechanism for pushing out a mold formed in the metal mold;

means for heating the vertically-split metal mold;

a mechanism for opening and closing the vertically-split metal mold;

means for injecting a foam mixture including a mixing bath to accommodate and mix granular aggregate, water-soluble binders, and water, and a pushing mechanism for pushing up the mixture in the mixing bath, wherein the mixing bath is cylindrical and has an opening at an upper end thereof, and a bottom plate at a lower end thereof that can be pushed up by the pushing mechanism;

means for mixing the granular aggregate, the water-soluble binders, and the water in the mixing bath of the means for injecting the mixture to form a foam mixture, wherein the means for mixing the mixture can be inserted into and removed from the mixing bath; and means for connecting the opening of the mixing bath to the filling ports of the vertically-split metal mold, wherein the means is disposed at a location that is apart from the mixing bath.

5. An apparatus for molding a mold, the apparatus comprising:

a horizontally-split metal mold having filling ports communicating with a cavity therein, which ports are disposed at a lower surface of a lower mold;

a mechanism for pushing out a mold formed in the metal mold;

means for heating the horizontally-split metal mold;

a mechanism for opening and closing the horizontally-split metal mold, means for injecting a foam mixture including a mixing bath to accommodate and mix granular aggregate, water-soluble binders, and water, and a mechanism for pushing up the mixture in the mixing bath, wherein the mixing bath is cylindrical and has an opening at an upper end thereof and a bottom plate at a lower end thereof that can be pushed up by the pushing mechanism;

means for mixing the granular aggregate, the water-soluble binders, and the water in the mixing bath of the means for injecting the mixture to form a foam mixture, wherein the means for mixing the mixture can be inserted into and removed from the mixing bath; and means for connecting the opening of the mixing bath to the filling ports of the horizontally-split metal mold, wherein the means is disposed at a location that is apart from the mixing bath.

6. The apparatus for molding a mold of claim 3, wherein the discharging port of the means for injecting the foam mixture can be connected to the filling port of the horizontally-split metal mold by horizontally moving the means for injecting the foam mixture.

7. The apparatus for molding a mold of claim 4, wherein the opening of the means for injecting the foam mixture can be connected to the filling ports of the vertically-split metal mold by horizontally and vertically moving the means for injecting the foam mixture.

8. The apparatus for molding a mold of claim 5, wherein the opening of the means for injecting the foam mixture can be connected to the filling ports of the horizontally split metal mold by horizontally and vertically moving the means for injecting the foam mixture.

9. The apparatus for molding a mold of any one of claims 3-5, wherein the means for heating is an electrical heater.

10. The method for filling a foam mixture of claim 1 or 2, wherein the mixing blades are inserted into and removed from the mixing bath through the opening thereof.

11. The apparatus for molding a mold of any one of claims 3-5, wherein the means for mixing are inserted into and removed from the mixing bath through the opening thereof.

* * * * *